United States Patent [19]

Mancuso

[11] Patent Number: 4,582,286

[45] Date of Patent: Apr. 15, 1986

[54] EASEL DISPLAY STAND

[76] Inventor: Robert J. Mancuso, 16 Myrtle St., Watertown, Mass. 02172

[21] Appl. No.: 641,070

[22] Filed: Aug. 15, 1984

[51] Int. Cl.[4] ..... A47B 97/04

[52] U.S. Cl. ..... 248/459; 40/152.1

[58] Field of Search ..... 248/465, 459, 174; 206/45.25, 45.24, 45.26; 40/152.1, 152.2, 155, 120, 124.1, 153, 154, 156, 157

[56] References Cited

U.S. PATENT DOCUMENTS

| | | | |
|---|---|---|---|
| 1,767,753 | 6/1930 | Frieberg | 248/459 |
| 2,025,280 | 12/1935 | Gregg | 206/45.24 X |
| 2,324,027 | 7/1943 | Rosenberg et al. | 40/152.1 |
| 2,783,013 | 2/1957 | Williamson | 206/45.25 X |
| 3,357,671 | 12/1967 | Ketterer | 248/459 |
| 3,473,777 | 10/1969 | Ketterer | 248/459 |
| 3,966,161 | 6/1976 | Nichols | 248/459 |
| 4,001,958 | 1/1977 | Fecko | 248/459 X |
| 4,291,798 | 9/1981 | Transport | 248/459 X |
| 4,357,769 | 11/1982 | Leahy | 248/459 X |

*Primary Examiner*—J. Franklin Foss

*Attorney, Agent, or Firm*—Joseph S. Iandiorio

[57] ABSTRACT

An easel display stand including: an easel support section having a trapezoidal hole; and an erectable easel section for face-to-face mounting with the support section having a base line; a spine; means for hingeably interconnecting the spine at the base line; a pair of side walls; means for hingeably interconnecting each of the side walls with a longitudinal edge of the spine; a pair of retainer portions; means for hingeably interconnecting each of the retainer portions with one of the side walls; the base line being generally aligned with the top of the trapezoidal hole and the means for hingeably interconnecting the retainer portions and the side walls being generally aligned with the angled sides of the trapezoidal hole when the easel section is erected through the trapezoidal hole.

25 Claims, 13 Drawing Figures

EASEL DISPLAY STAND

FIELD OF INVENTION

This invention relates to an easel display stand.

BACKGROUND OF INVENTION

Conventional inexpensive display stands are usually made of paper or cardboard or other suitable material. There is typically a support section with a die-cut portion that can be swung out to provide a leg on which the display stand can rest for free-standing applications. The front of the display may be used for messages, menus, or the like, or may be provided with a frame section if photographs are to be mounted in it for display. These stands are typically flimsy and quick to deteriorate. The leg weakens and will not stay out in its proper supporting position, the frame separates from the display, and the overall impression is not pleasing. These stands are usually made from two or more pieces of paper or cardboard which are glued together. When the paper ages and curls and the glue dries the stand begins to deteriorate.

SUMMARY OF INVENTION

It is therefore an object of this invention to provide an improved, simple, inexpensive easel display stand.

It is a further object of this invention to provide such an easel display stand which is stronger and is finished on all sides.

It is a further object of this invention to provide such an easel display stand which can be made from a single blank of material.

It is a further object of this invention to provide such an easel display stand which can be made from a single blank of material printed on one side only.

This invention features an easel display stand including an easel support section having a trapezoidal hole and an erectable easel section for face-to-face mounting with the support section. The easel section has a base line, a spine, and means for hingeably interconnecting the spine at the base line. There are a pair of side walls and means for hingeably interconnecting each of the side walls with a longitudinal edge of the spine. There is a pair of retainer portions and means for hingeably interconnecting each of the retainer portions with one of the side walls. The base line is generally aligned with the top of the trapezoidal hole, and the means for hingeably interconnecting the retainer portions and side walls are generally aligned with the angled sides of the trapezoidal hole when the easel section is erected through the trapezoidal hole.

In a preferred embodiment, the means for hingeably interconnecting the spine to the base line and the spine to the side walls, as well as interconnecting the side walls to the retainer portions, may all be fold lines or scores. The fold lines which hingeably interconnect the side walls to the retainer portions may extend from proximate the base line partway along the junction of the side walls and retainer portions, with the side walls and retainer portions being separated thereafter such as by a cut along an extension of the fold line. The spine may be generally rectangular and the side walls generally triangular. The fold lines which interconnect the side walls and retainer portions may extend generally outwardly from the intersections of the base line with the longitudinal edges of the spine. The side walls may include an intermediate fold line between the junction with the associated retainer portion and the longitudinal edge of the spine. Those fold lines may extend generally from the intersections of the base line and the longitudinal edges of the spine. The retainer portions may have a side parallel to the base line and a side parallel to the longitudinal edges of the spine. The easel section and easel support section may be hingeably interconnected.

The display stand may include a display section, and the display section may be hingeably interconnected with the easel section and the easel support section. The display section may connect with the easel section proximate the base line and with the easel support section proximate the base of the trapezoidal hole. The display section may include retainer flaps for folding over the easel and easel support sections when they are folded against the display section. There may be a frame section hingeably interconnected with the easel support section proximate the top of the trapezoidal hole. The frame section may incude retainer flaps for folding over the display, easel and easel support sections when they are folded against the frame section.

The invention also features a blank for forming an easel display stand, including an easel support section with a trapezoidal hole, a display section, and an erectable easel section for face-to-face mounting with the support section. The easel section has a base line, spine, and means for hingeably interconnecting the spine at the base line. There is a pair of side walls and means for interconnecting each of the side walls with a longitudinal edge of the spine. There is a pair of retainer portions and means for hingeably interconnecting each of the retainer portions with one of the side walls. The base line is generally aligned with the top of the trapezoidal hole and the means for hingeably interconnecting the retainer portions and side walls are generally aligned with the angled sides of the trapezoidal hole when the easel section is erected through the trapezoidal hole.

The display section may be hingeably interconnected with the easel support section proximate the base of the trapezoidal hole and with the easel section proximate the base line.

There may be a frame section hingeably interconnected with the easel support section proximate the top of the trapezoidal hole.

The invention also contemplates a two-part easel display stand, which includes a first part having a frame section and an easel support section, and a second part having a display section and an easel section as described previously in detail. In the first part, the frame section may be hingeably interconnected with the easel support section proximate the top of the trapezoidal hole for allowing those sections to be swung into a face-to-face relationship to form a holder for receiving the second part. In the second part, the display section may be hingeably interconnected with the easel section proximate the base line for allowing those sections to be swung into face-to-face position. At least the frame section of the first part may be transparent.

DISCLOSURE OF PREFERRED EMBODIMENT

Other objects, features and advantages will occur from the following description of a preferred embodiment and the accompanying drawings, in which:

FIG. 1 is a plan view of a blank from which an easel display stand according to this invention may be formed;

FIGS. 2A, B, C and D comprise a schematic showing of a step-by-step folding of the blank of FIG. 1 to form an easel display stand according to this invention;

Figure 1:
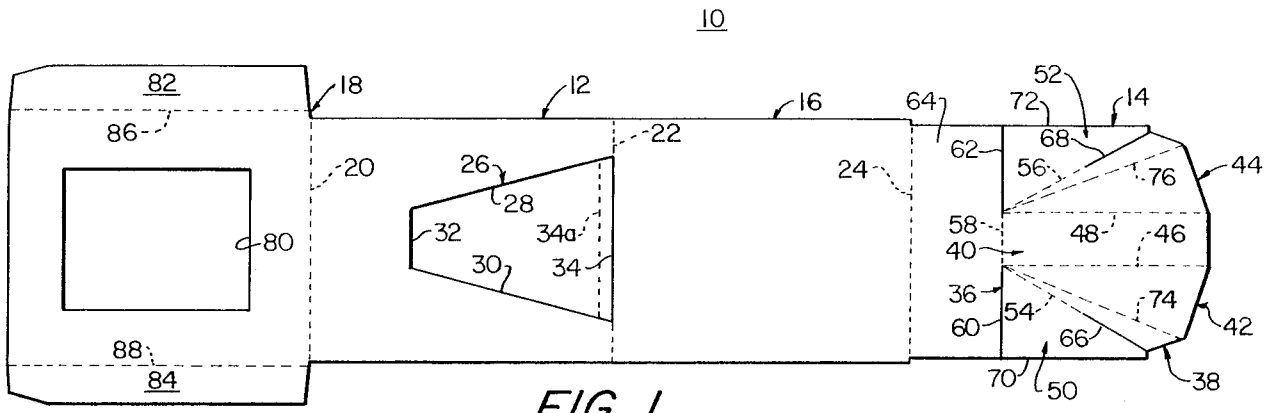
Figure 7A:
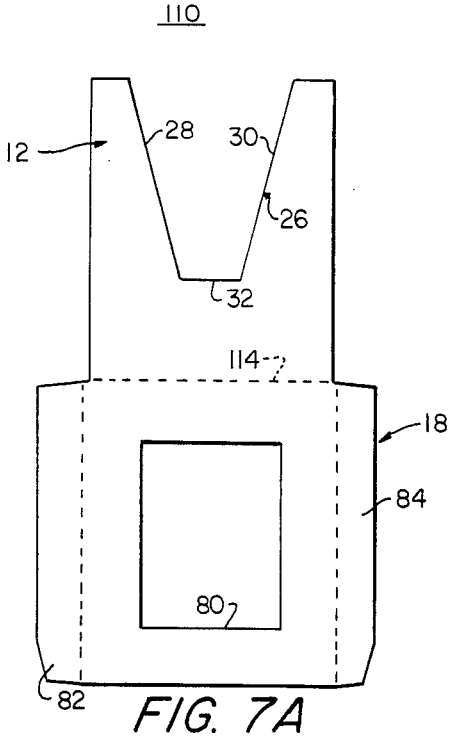
Figure 7B:
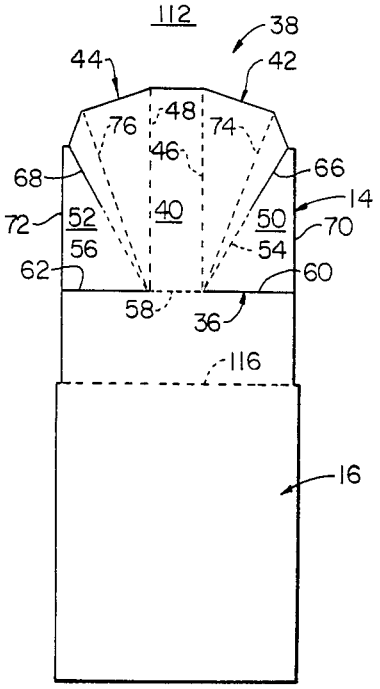
Figure 8:
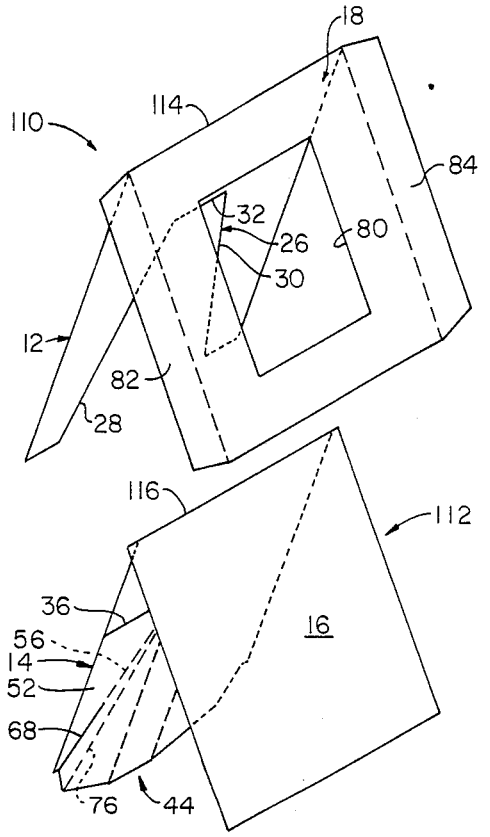
Figure 9:
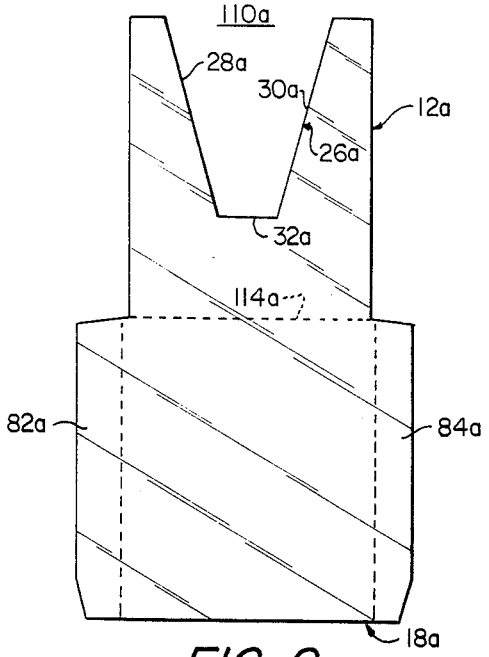
Figure 10:
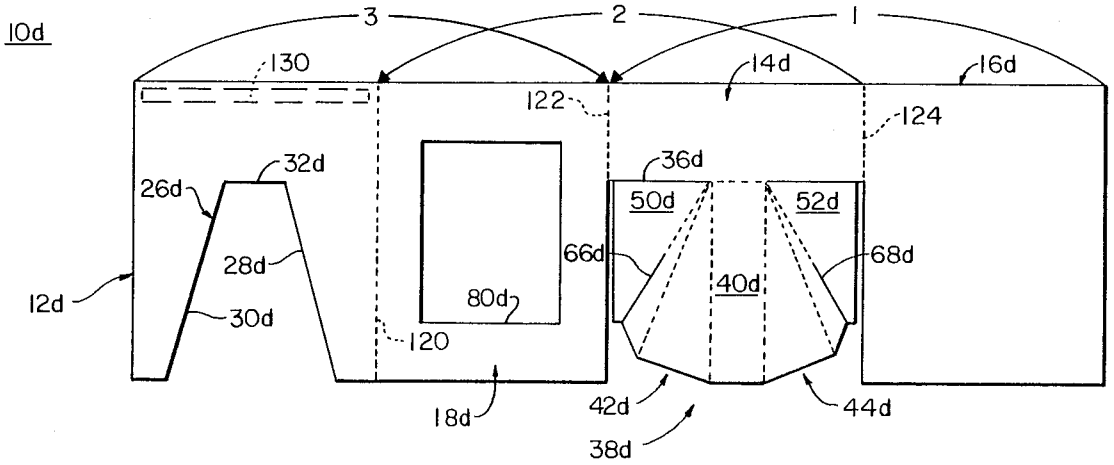
Figure 11:
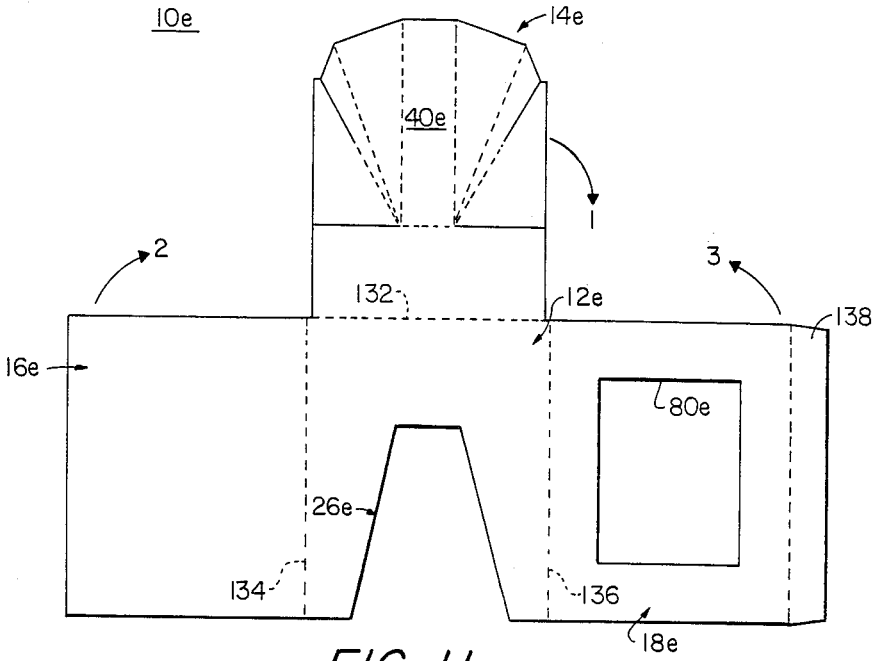
Figure 12:
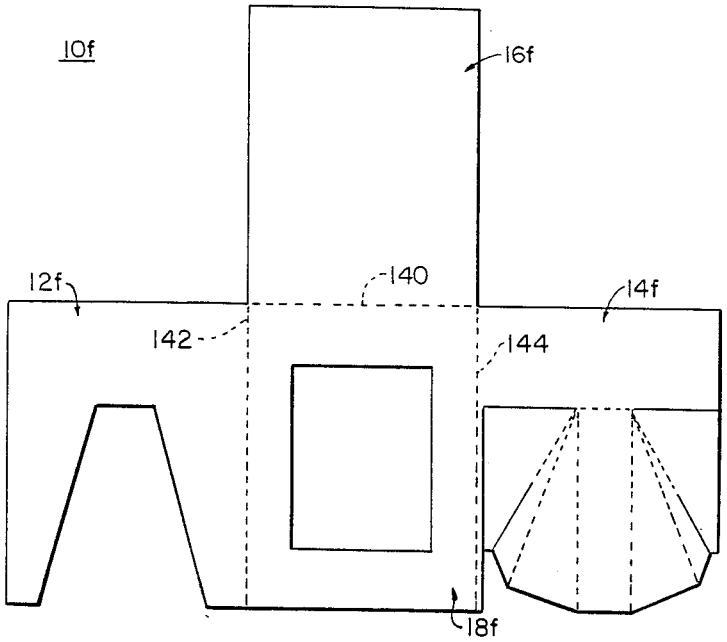

FIGS. 7A and B are plan views of two blanks used to form a two-part easel display stand according to this invention;

FIG. 8 is an exploded isometric view of the two parts shown in FIGS. 7A and B partially assembled and approaching insertion;

FIG. 9 is a view of a part similar to that shown in FIG. 7A which is fully transparent; and FIGS. 10, 11 and 12 are plan views of four section blanks which are variations on that shown in FIG. 1 according to this invention.

There is shown in FIG. 1 a blank 10 which can be made out of paper, plastic, metal, cardboard or any suitable material, preferably paper or cardboard. Blank 10 includes four sections: easel support section 12, easel section 14, display section 16, and frame section 18, which are hingeably interconnected with each other by means of scores or fold lines 20, 22, and 24. If it is desired, the sections may be cut along those lines and separately assembled as described hereafter, but the more practical approach is to use the blank as an integral piece. Easel support section 12 includes a trapezoidal hole 26 having two angled sides 28 and 30, a top 32, and a base 34. Base 34 may be along the fold line 22 as shown, or may be anywhere above it as indicated by a bottom line 34*a*, shown in phantom. Similarly, the top 32 of trapezoid 26 may be located anywhere in section 12, even along fold line 20 between sections 12 and 18.

Easel section 14 includes a theoretical base line 36, which may be located anywhere in that section. A stand portion 38 includes a spine 40 having two side walls 42, 44 interconnected with it by means of fold lines 46 and 48. Side walls 42 and 44 are in turn hingeably interconnected with retainer portions 50 and 52 by fold lines 54 and 56. The entire stand 42 is attached to base 64 by fold line 58 which is coincident with base line 36 at the top of spine 40. The rest of base line 36 is cut as at 60 and 62 to separate retainer portions 50 and 52 from the remaining base section 64, if there is any, of easel section 14. Fold lines 54 and 56 which interconnect retainer portions 50, 52 with side walls 42 and 44, respectively, extend only partway along the junction of their respective side walls and retainer portions. The remainder of the fold lines are cut as at 66 and 68 to form a separation between the retainer portions and side walls. Spine 40 is generally rectangular in shape, with side walls 42 and 44 joining it along its longitudinal edges. Retainer portions 50 and 52 have their upper edges parallel to base line 36 and their sides 70 and 72 generally parallel to the fold lines 46, 48 at the longitudinal edges of spine 40. Retainer portions 50, 52 may be thought of as generally triangular in shape, while stand 38 may be thought of as generally trapezoidal in shape. Side walls 42 and 44 are generally triangular in shape. Additional fold lines 74, 76 may be placed intermediate fold lines 54 and 46 and 56 and 48, respectively, extending to the intersections of base line 36 and fold lines 46 and 48. These fold lines serve to make stand 38 more easily erected through trapezoidal hole 26 when the display stand is in its final form. Lines 74, 76 need not actually extend all the way to the intersection of base line 36 and lines 46 and 48, but may end short of there at 75, 77.

Display section 16 may be simply a blank face where a promotional message or sample photograph may be placed to be visible through the cutout 80 of frame section 18. Frame section 18 may include a pair of flaps 82, 84 interconnected with the main section by fold lines 86, 88.

Figure 2:
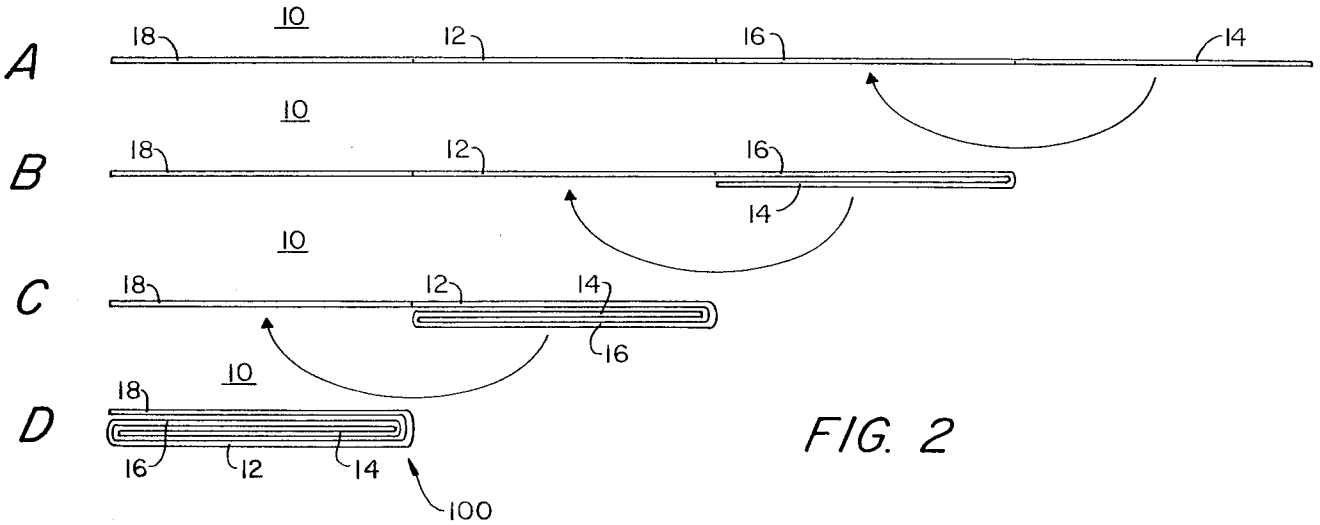
Figure 4:
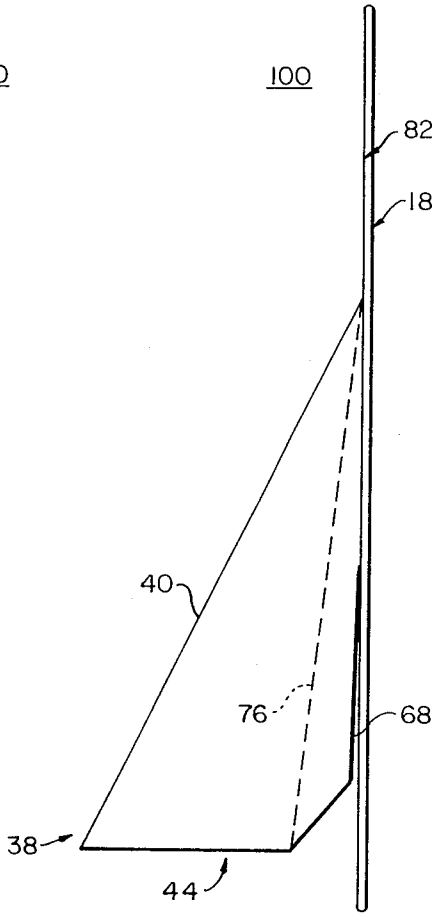
FIG. 4 is a side view of the stand of FIG. 3.
Figure 3:
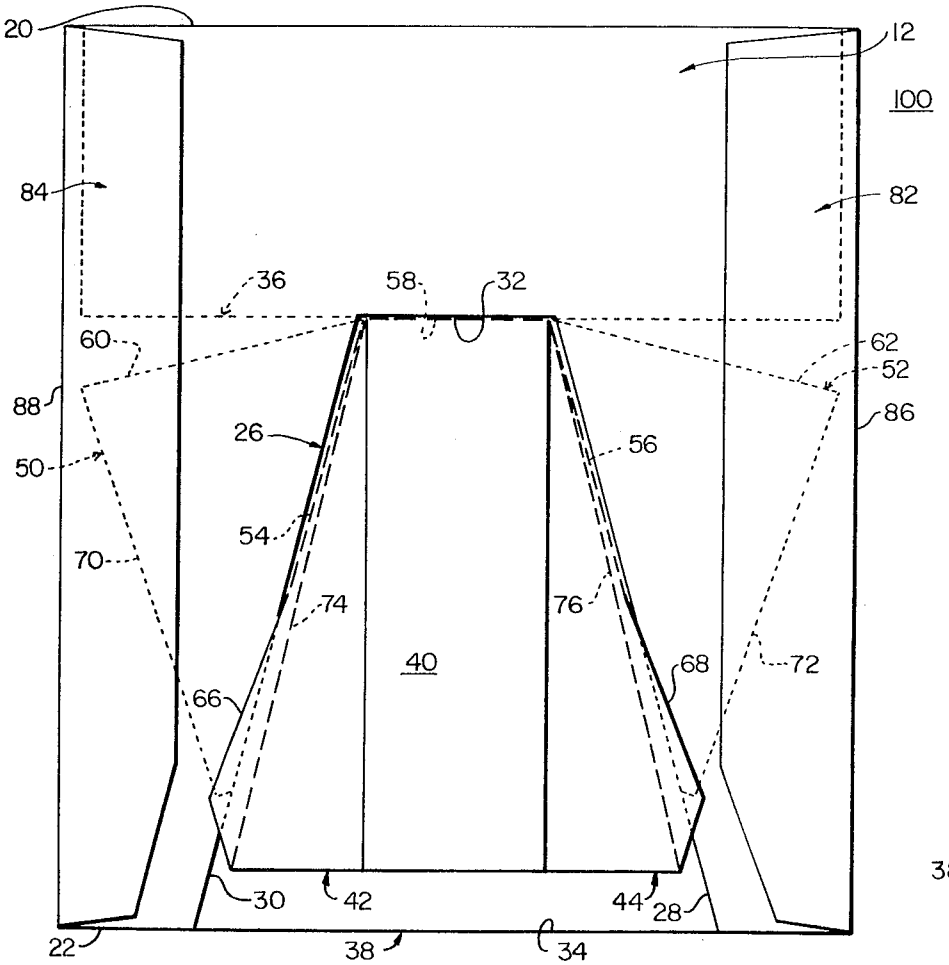
FIG. 3 is a rear view of a completed stand formed from the blank of FIG. 1.

Blank 10, FIG. 1, may be made from a single piece of material, all printed on the same side. It may then be folded as shown in FIGS. 2A–D. With the blank lying flat as schematically shown in FIG. 2A, section 14 is folded under section 16 as shown FIG. 2B. Then sections 14 and 16 are both folded under section 12, FIG. 2C, which in turn is folded under section 18 to complete the operation and produce the resulting stand 100. From the front, stand 100 appears exactly as frame section 18, FIG. 1, without the flaps 82 and 84 showing. From the rear, FIGS. 3 and 4, stand 100 appears as shown with flaps 82 and 84 folded in; fold line 20 is visible at the top and fold line 22 is visible at the bottom. The backmost section is support section 12, which contains trapezoidal hole 26. Stand 38 is erected in FIG. 3. This is accomplished by pulling spine 40 out at its bottom end so that it swings about its fold line 58 coincident with base line 36, shown in phantom. Fold lines 74 and 76 have bent somewhat to allow side walls 42 and 44 to be pulled through trapezoidal hole 26 so that fold lines 54 and 56 align generally with the angular sides 30 and 28 of trapezoidal hole 26. Side walls 42 and 44 have sprung out and overlapped the edges of trapezoidal hole 26 at cuts 66 and 68 to thereby lock stand 38 in the erect position. In this erected position, retainer portions 50 and 52 have been moved downwardly so that their upper edges 60 and 62 are separated from base line 36.

Figure 5:
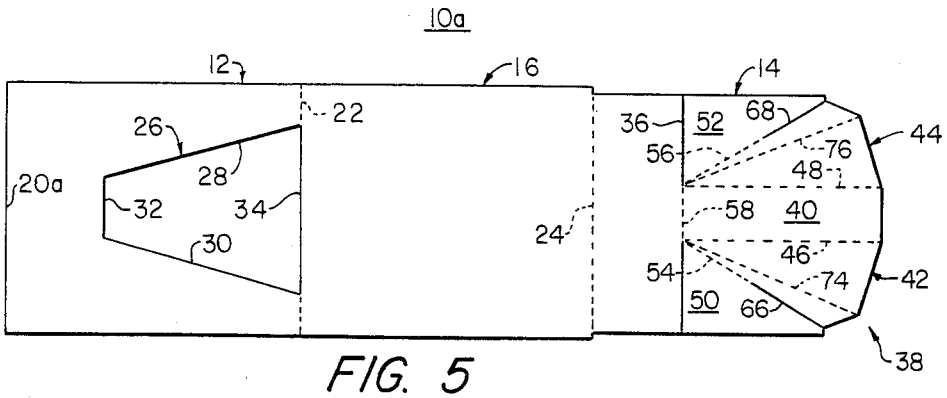
FIG. 5 is a simpler blank, having only three sections, from which an easel display stand according to this invention may be formed.

A simpler blank 10*a*, FIG. 5, having only three sections, easel support section 12, easel section 14, and display section 16, may also be used to construct a stand according to this invention. The elimination of frame section 18 by making fold line 20*a* a cut line leaves the remainder of the blank 10*a* intact, and the folding assembly progresses in the same way as the folding of blank 10.

Figure 6:
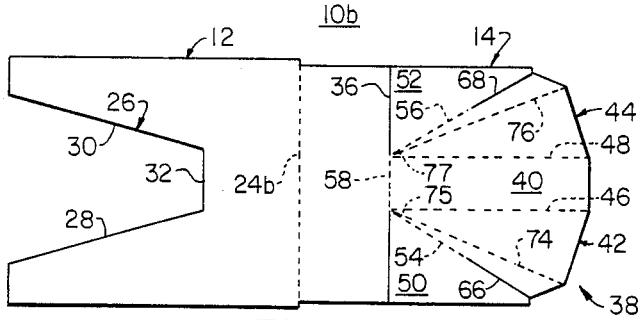
FIG. 6 is a plan view of a blank of yet simpler form, employing only two sections, to form a display stand according to this invention.

An even simpler blank 10*b*, FIG. 6, for constructing a stand according to this invention utilizes simply the support section 12 and easel section 14, which are joined together at fold line 24*b*, which is in the same relative position with respect to the easel section 14*b* but is at the edge of easel support section 12*b* proximate the top 32 of trapezoidal hole 26. To construct a stand with blank 10*b*, sections 12 and 14 are simply swung together about score or fold 24*b* until they are in face-to-face relationship, and then spine 40 is pulled through trapezoidal hole 26 as explained previously. The blanks of FIGS. 5 and 6 are both shown with their sections all joined and hingeably interconnected by scores or fold lines, which is the preferred construction, although the parts may be separate and separately assembled.

The invention may also be accomplished using two parts 110, 112, FIGS. 7A and B. Part 110 includes a support section 12 joined at fold line 114 to frame section 18. The second part 112 includes a display section 16 joined at fold line 116 to easel section 14. When easel section 14 is folded behind display section 16 and easel support section 12 is folded behind frame section 18, parts 112 and 110, respectively, appear as shown in FIG. 8, where the two sections of each part have been shown slightly separated for clarity and understanding. The assembly of part 110 is completed by placing frame section 18 flat against easel support section 12, wrapping flaps 82 and 84 around easel support section 12, and adhering them there. Then sections 16 and 14 of part 112 are held flat against each other and inserted in the pocket formed by part 110. Finally, spine 40 is pulled out through trapezoidal hole 26 as explained previously with respect to FIGS. 1–4. Although base line 36 is shown in the figures, it is not necessarily a visible part of the device. It is shown to aid understanding and is not normally printed on the blanks.

Part 110, FIG. 7A, may be constructed so that at least the frame section 18*a*, FIG. 9, is formed of a transparent material so that a photograph or other item to be displayed may be easily seen through it. In that case, second part 112 may comprise only section 14, which is slipped in the pocket formed by part 110*a*, after which a photograph or other item to be displayed can be slipped in between frame section 18*a* and easel section 14.

If it is chosen to implement the invention using a single blank, a number of variations may be employed using the same three or four sections. For example, a blank 10*d*, FIG. 10, may have support section 12*d* joined in side-by-side relationship at fold 120 with frame section 18*d*, which in turn is joined at fold line 122 with easel section 14*d*, whose other edge is connected at fold line 124 with display section 16*d*. Blank 10*d* may be folded to obtain the stand, such as stand 100, in accordance with this invention by folding as shown by following the arrow lines bearing the encircled numbers 1, 2, 3. After folding is complete, an adhesive 130 on the back side of easel support section 12*d* is used to keep the stand together. All of the sections and blank 10*d* are printed on the same side. This is not true of blank 10*e*, shown in FIG. 11. There, easel section 14*e* must be printed on its back side, as shown in the figure, if information or color is desired for that section. Although in earlier figures flaps with adhesives were used, that is not a necessary limitation of the invention, as other means such as adhesive strips carried by various ones of the sections may be used to facilitate securing the stand once it is folded. Blank 10*e* has easel section 14*e* attached to easel support section 12*e* by fold line 132, while easel support section 12*e* is in turn foldably interconnected with display section 16*e* and frame section 18*e* by fold lines or scores 134 and 136, respectively. A flap 138 with suitable adhesive may be provided on one end of frame section 18*e* to seal together the blank after it is folded to keep it in the form of a stand.

The final example of a four-section blank configuration is illustrated with blank 10*f*, FIG. 12, in which frame 18*f* is interconnected along fold 140 with display section 16*f*, along fold line 142 with easel support section 12*f*, and along fold line 144 with easel section 14*f*.

Other embodiments will occur to those skilled in the art and are within the following claims:

What is claimed is:

1. An easel display stand comprising: an easel support section having a trapezoidal hole; and an erectable easel section for face-to-face mounting with said support section, having a base line, a spine, means for hingeably interconnecting said spine at said base line, a pair of side walls, means for hingeably interconnecting each of said side walls with a longitudinal edge of said spine, a pair of retainer portions, means for hingeably interconnecting each of said retainer portions with one of said side walls, said base line being generally aligned with the top of said trapezoidal hole and said means for hingeably interconnecting said retainer portions and said side walls being generally aligned with the angled sides of said trapezoidal hole when said easel section is erected through said trapezoidal hole.

2. The easel display stand of claim 1 in which said means for hingeably interconnecting said spine to said base line is a fold line.

3. The easel display stand of claim 1 in which said means for hingeably interconnecting said side walls are fold lines.

4. The easel display stand of claim 1 in which said means for hingeably interconnecting said side walls to said retainer portions are fold lines which extend from proximate said base line partway along the junction of said side walls and retainer portions and said side walls and retainer portions are separated thereafter.

5. The easel display stand of claim 1 in which said spine is generally rectangular.

6. The easel display stand of claim 1 in which said side walls are generally triangular.

7. The easel display stand of claim 3 in which said fold lines interconnecting said side walls and retainer portions extend generally outwardly from the intersections of said base line and the longitudinal edges of said spine.

8. The easel display stand of claim 1 in which said walls include an intermediate fold line between the junctions with the associated retainer portion and longitudinal edge of said spine, and said fold lines extend generally from the intersections of said base line and said longitudinal edges of said spine.

9. The easel display stand of claim 1 in which said retainer portions have a side parallel to said base line.

10. The easel display stand of claim 1 in which said retainer portions have a side parallel to said longitudinal edges of said spine.

11. The easel display stand of claim 1 in which said easel section and easel support section are hingeably interconnected.

12. The easel display stand of claim 1 which includes a display section.

13. The easel display stand of claim 12 in which said display section is hingeably interconnected with said easel section and easel support section.

14. The easel display stand of claim 13 in which said display section is hingeably interconnected with said easel section proximate the base of said trapezoidal hole.

15. The easel display stand of claim 14 in which said display section includes retainer flaps for folding over said easel and easel support sections when they are folded against said display section.

16. The easel display stand of claim 14 which includes a frame section hingeably interconnected with said easel support section proximate the top of said trapezoidal hole.

17. The easel display stand of claim 16 in which said frame section includes retainer flaps for folding over said display, easel and easel support sections when they are folded against said frame section.

18. A blank for forming an easel display stand comprising: an easel support section having a trapezoidal hole; a display section; and an erectable easel section for face-to-face mounting with said support section, having a base line, a spine, means for hingeably interconnecting said spine at said base line, a pair of side walls, means for hingeably interconnecting each of said side walls with a longitudinal edge of said spine, a pair of retainer portions, means for hingeably interconnecting each of said retainer portions with one of said side walls, said base line being generally aligned with the top of said trapezoidal hole and said means for hingeably interconnecting said retainer portions and said side walls being generally aligned with the angled sides of said trapezoidal hole when said easel section is erected through said trapezoidal hole.

19. The blank of claim 18 in which said display section is hingeably interconnected with said easel support section proximate the base of the trapezoidal hole and with said easel section proximate said base line.

20. A blank for forming an easel display stand comprising: an easel support section having a trapezoidal hole; a frame section; a display section; and an erectable easel section for face-to-face mounting with said support section, having a base line, a spine, means for hingeably interconnecting said spine at said base line, a pair of side walls, means for hingeably interconnecting each of said side walls with a longitudinal edge of said spine, a pair of retainer portions, means for hingeably interconnecting each of said retainer portions with one of said side walls, said base line being generally aligned with the top of said trapezoidal hole and said means for hingeably interconnecting said retainer portions and said side walls being generally aligned with the angled sides of said trapezoidal hole when said easel section is erected through said trapezoidal hole.

21. The blank of claim 20 in which said display section is hingeably interconnected with said easel support section proximate the base of the trapezoidal hole and with said easel section proximate said base line, and said frame section is hingeably interconnected with said easel support section proximate the top of said trapezoidal hole.

22. A two part easel display stand comprising: a first part having a frame section having a trapezoidal hole and an easel support section; and a second part having a display section and an easel section which includes an erectable easel section for face-to-face mounting with said support section, having a base line, a spine, means for hingeably interconnecting said spine at said base line, a pair of side walls, means for hingeably interconnecting each of said side walls with a longitudinal edge of said spine, a pair of retainer portions, means for hingeably interconnecting each of said retainer portions with one of said side walls, said base line being generally aligned with the top of said trapezoidal hole and said means for hingeably interconnecting said retainer portions and said side walls being generally aligned with the angled sides of said trapezoidal hole when said easel section is erected through said trapezoidal hole.

23. The two-part easel display stand of claim 22 in which said display section is hingeably interconnected with said easel section proximate said base line for swinging those sections into face-to-face position.

24. The two-part easel display stand of claim 23 in which said frame section is hingeably interconnected with said easel support section proximate the top of said trapezoidal hole for swinging those sections into face-to-face relationship to form a holder for receiving said second part.

25. The two-part easel display stand of claim 22 in which at least the frame section of said first part is transparent.

* * * * *